United States Patent [19]

Nordbeck

[11] Patent Number: 4,998,499

[45] Date of Patent: Mar. 12, 1991

[54] UNDERWATER PNEUMATIC HORN

[76] Inventor: Ellis L. Nordbeck, 327 Crooked Creek, Leonard, Mich. 48367

[21] Appl. No.: 458,503

[22] Filed: Dec. 28, 1989

[51] Int. Cl.[5] ..... G10K 9/00

[52] U.S. Cl. ..... 116/142 FP; 116/137 R

[58] Field of Search ..... 116/70, 142 FP, 142 R, 116/137 R, 140

[56] References Cited

U.S. PATENT DOCUMENTS

| | | | |
|---|---|---|---|
| 1,746,034 | 2/1930 | Farmer | 116/142 FP |
| 2,142,221 | 1/1939 | Stevens | 116/142 FP |
| 2,281,611 | 5/1942 | Williams | 116/142 FP |
| 3,581,705 | 6/1971 | Holm | 116/142 FP |
| 4,227,482 | 7/1979 | Scheindel | 116/142 FP |
| 4,852,510 | 8/1989 | Joseph, Jr. et al. | 116/140 |

*Primary Examiner*—William A. Cuchlinski, Jr.
*Assistant Examiner*—Daniel G. DePumpo
*Attorney, Agent, or Firm*—Alfred E. Wilson

[57] ABSTRACT

A system whereby the air pressure from the scuba diver's tank is reduced in pressure and is available to blow a horn. When not submerged the horn can be heard for a long distance, up to a mile or more. When in the water the horn produces vibrations and noise which can be detected for a hundred yards or more.

3 Claims, 2 Drawing Sheets

UNDERWATER PNEUMATIC HORN

FIELD OF THE INVENTION

My invention is a safety device for use by scuba divers to enable them to contact their buddy in the event that the parties become separated from each other and can no longer see each other. The horn is pressure activated and derives its air pressure from the tank which scuba divers carry on their backs.

DESCRIPTION OF THE PRIOR ART

Heretofore, it has been customary for divers to attempt to stay within sight of each other when two or more divers are scuba diving. That is frequently somewhat difficult to do because scuba divers frequently feel a sensation of freedom of movement, and as a result they get separated, particularly if the water is not clear and as a result it is very easy for the parties to lose contact with each other. Heretofore scuba divers have been dependent on the noise they could make by tapping with a metal object on the metallic portions of their equipment. When not separated if they wish to communicate with each other they have used slates on which to write short messages or sketch symbols that are meaningful to their scuba diving partners.

While many patents have issued on various phases of scuba diving insofar as is known, no one has succeeded in developing a piece of diving equipment that would enable a diver, while submerged to blow a whistle and thus communicate with his partner up to as much as 100 yards away.

SUMMARY OF THE INVENTION

In view of the fact that the pressure in the tank is much higher than can be tolerated by an air actuated horn it is necessary to have buoyancy pressure reducers to drop the pressure to a safe pressure at which the horn can be actuated. At the start of a dive the pressure of the air in the tank ranges up to approximately 3,000 pounds per square inch. The tank is strapped on the back and a buoyancy compensator vest is worn. The horn actuator is readily available to the scuba diver merely by depressing a button which is generally carried at the front of the buoyancy compensator.

BRIEF DESCRIPTION OF THE DRAWINGS

Referring now to the drawings wherein similar reference characters refer to similar parts throughout the several views.

DESCRIPTION OF THE PREFERRED EMBODIMENT

Figure 1:
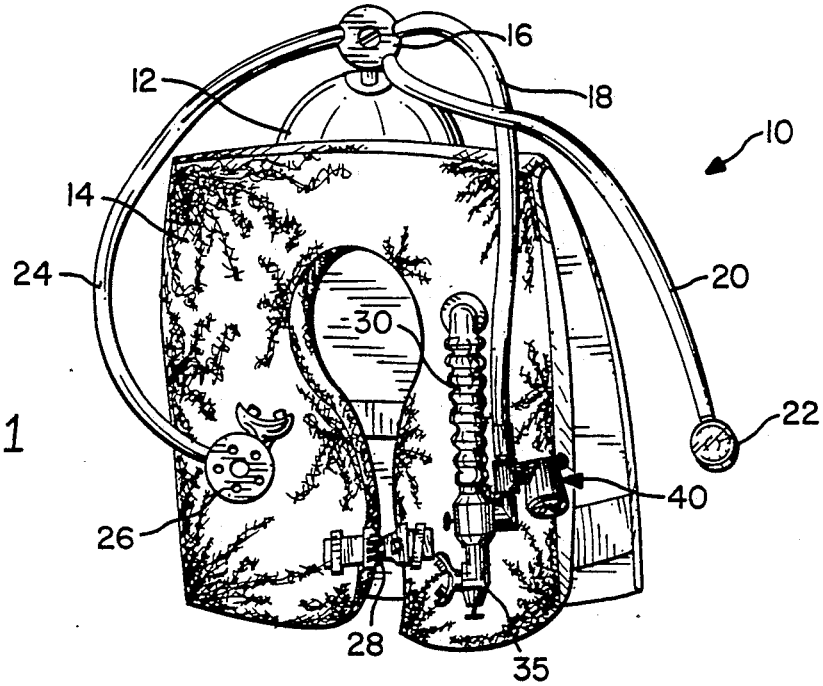
FIG. 1 is a front perspective view of a buoyancy regulator vest embodying my invention.

Scuba under water equipment 10 illustrated in FIG. 1 embodies a compressed air tank 12 which may be mounted on a buoyancy compensator vest 14 to be worn by a scuba diver to control the pressure in the vest. The air tank 12 has compressed air at a pressure of approximately 3,000 pounds per square inch when the tank is picked up to start a dive. The controls and connection of the scuba equipment are connected to the tank 12, and reduce the air pressure admitted to the scuba vest 14 dependent on the depth that the scuba diver wishes to operate, the deeper the dive the higher the pressure needs to be in the vest 14. The scuba self contained underwater breathing apparatus is in the shape of a vest and is secured to the scuba diver's body by a buckle 28 or other suitable tie.

The distributor valve 16 which controls the first stage pressure reducer controls the flow of air out of the tank 12. One of the lines 20 out of the tank 12 goes to a pressure gauge 22 which the diver can readily observe to see how such air pressure is still in the tank to enable him to judge the time that he has remaining in the dive, depending on his rate of using the breathable air from the tank 12.

Another line 24 is a second stage line which goes to the second stage regulator 26 having a suitable mouth piece whereby breathable air is supplied to the diver.

The pneumatic horn 40 is located in parallel relation to the low pressure line 18 from tho pressure supply tank 12 and is spaced in parallel with the standard buoyancy compensation vest 14 by means of a flexible hose 30.

Figure 2:
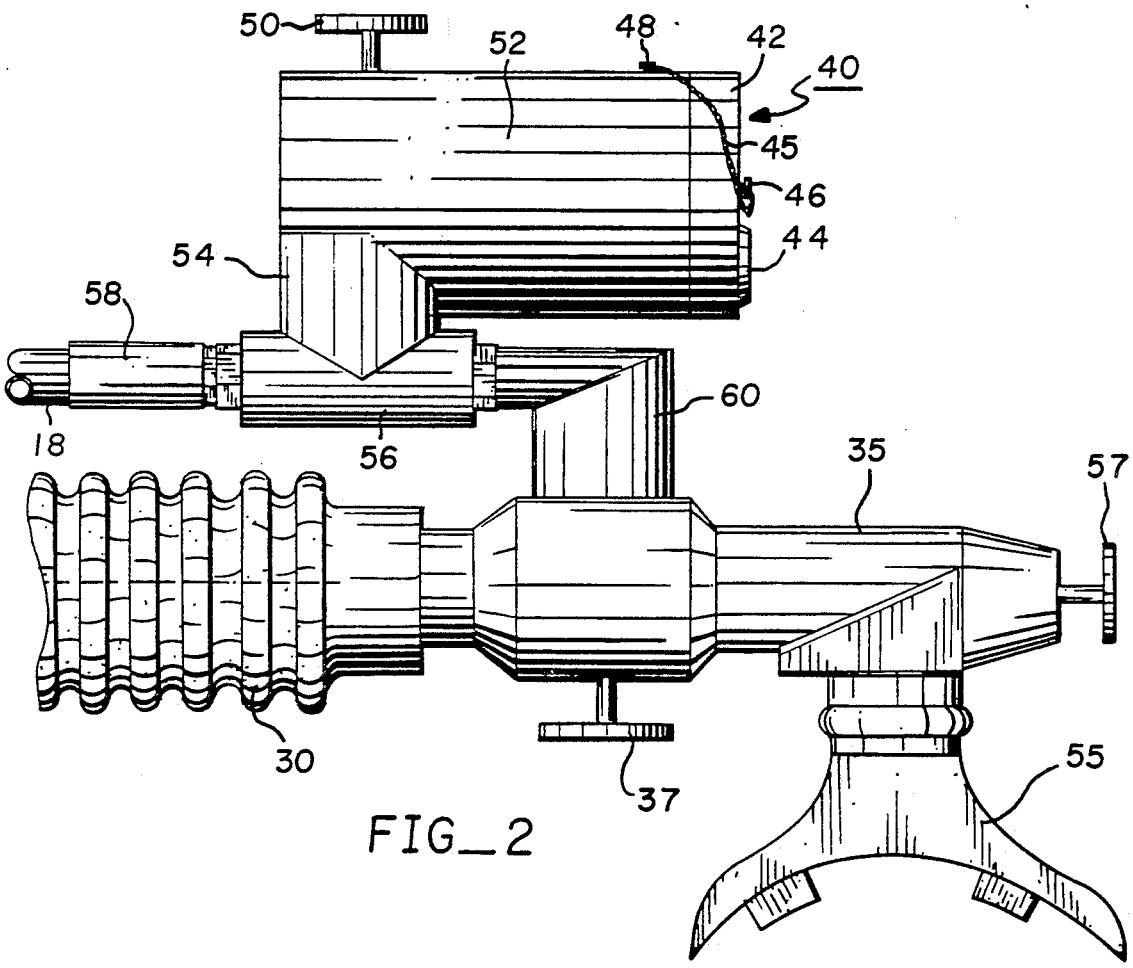
FIG. 2 is a side elevation of the apparatus embodying the horn.

In FIG. 2, the pneumatic horn 40 is shown with a lid 42 with purge vents (not shown) covered by a rubber purge valve 44. The lid 42 is unscrewed when signaling above water and is retained by a lanyard 45 of chain links attached to a rivet 46 which is secured to the lid 42. The other end of the lanyard 45 is attached to a rivet 48 located on the horn housing 52.

When operating under water the lid 42 is applied by the threaded connection 42 to render the horn operable to exert pressure from the diaphragm 102 to be expressed as impulses in the horn structure which exerts rapidly recurring pressure which can be detected by another scuba diver.

The purpose of the lid 42 when the horn is operated while under water is to prevent water from filling the cone of the horn, and to permit the diaphragm 102 to vibrate while under water to transmit a message through the water to other scuba divers who are in the area. Purge vents, (not shown), covered by a rubber purge valve 44 are provided to dissipate water from the inner conical shaped vibrator of the horn.

The pneumatic horn 40 is activated by means of a push button 50. The push button housing 54 is connected to the air line 56. The entire unit snaps between the female quick-connector 58 and the "L"-shaped connector 60 which is a standard part of the buoyancy compensator valve 35.

The power inflator button 37 releases air from the tank 12 and inflates the vest 14 via the flexible rubber hose 30. An alternative to this is by means of an oral inflator 55 with the control button 57.

Figure 3:
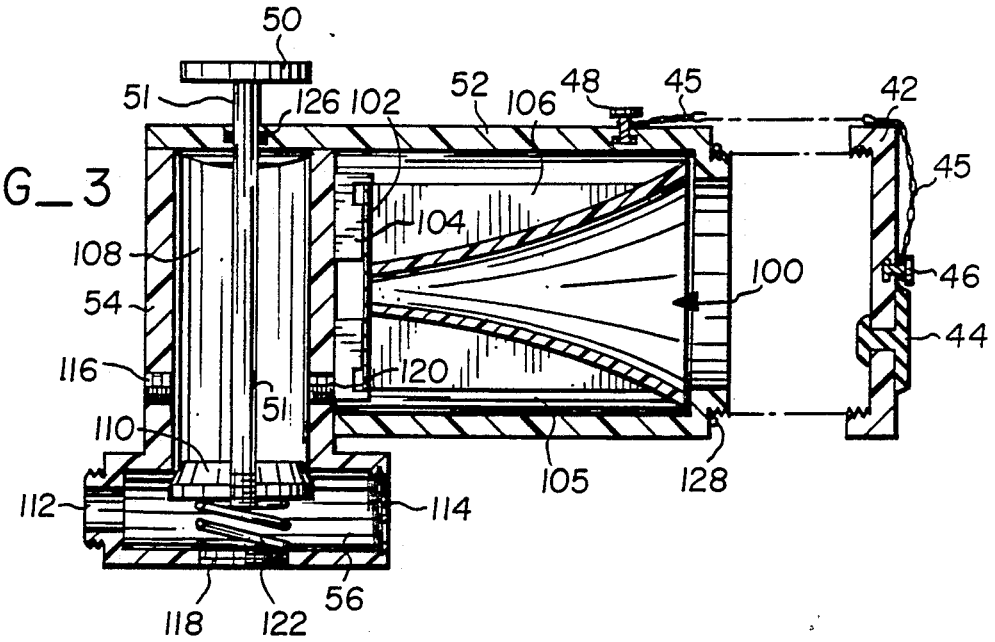
FIG. 3 is a sectional view of the horn apparatus illustrated in FIG. 2.

FIG. 3 is a sectional view revealing the interior of the device including the plastic horn 100 and a thin metal diaphragm 102 retained by four plastic fins 104 radially located within the resonating chamber 105. The four plastic support fins 16 are similarly located radially about the horn 100 which is designed to create a very loud noise above water and, a noise that is audible underwater up to 100 yards as dive "buddies" tend to drift apart. This pneumatic horn is comprised of a push button 50 activator connected by threaded means to the air release/stopper valve 110 by a rod 51 which runs through air chamber 108.

The push button 50 is retained in the "off" position by a spring 122 which is placed in the air line 56 by removing a threaded plug 118. In the off-position, air is free to travel from the male adapter 112 through the spring 122 to the female adapter 114 so that the buoyancy compensator can be used. When the push button 50 is depressed the unit is in the "on" position, and the air from the tank enters the air chamber 108 at a low pressure (approximately 75 P.S.I. to 125 P.S.I.). The air pressure is further reduced by an orifice in the set screw 120 to a pressure suited to the characteristics of the horn (approximately 22 P.S.I. to 50 P.S.I.).

A threaded plug 116 is located externally on the push button housing 54 and its purpose is for the replacement of the set screw 120. It is preferable that the pneumatic horn 40 be made of injection-molded plastic and be of more that one piece as shown by horn housing 52 and the push button housing 54.

Figure 4:
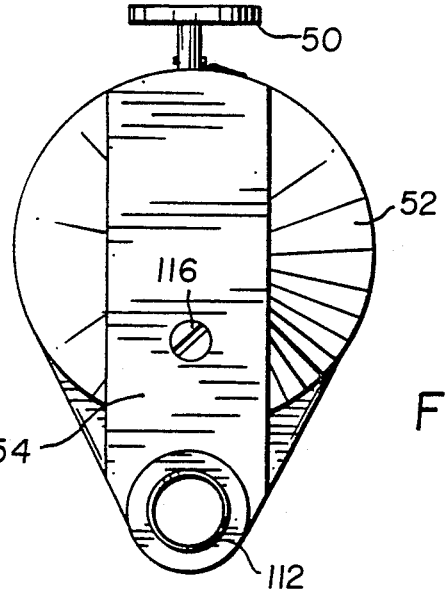
FIG. 4 is a rear elevational view of the device illustrated in section in FIG. 3.
Figure 5:
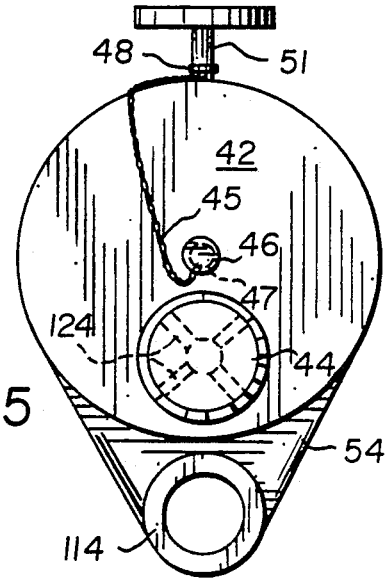
FIG. 5 is a front elevational view of the horn mechanism.
Figure 6:
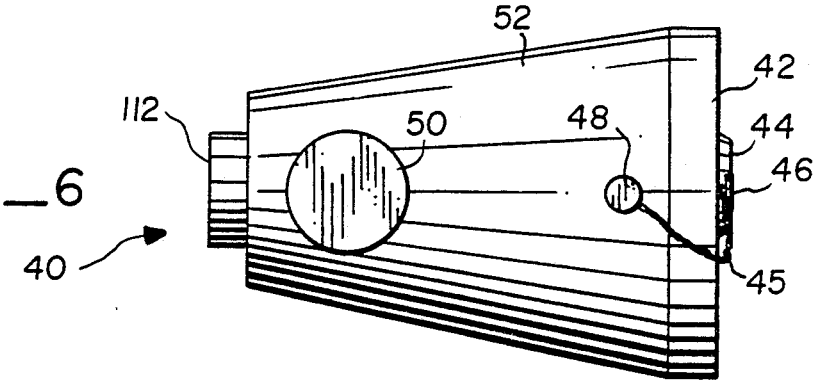
FIG. 6 is a top elevational view of the Underwater Pneumatic horn illustrated in FIGS. 4 and 5.

Furthermore, the whole unit is made watertight by a minimum of two "O"-rings, the push button O-ring 126 and the cover O-ring 128 (both made of rubber). It should be noted that rivets 46 and 48 are fully set in the injection-molded plastic of the lid 42 and the horn housing 52, respectively. FIGS. 4, 5, and 6 serve to further illustrate the preferred embodiment of the pneumatic horn 40. In FIG. 5, a tiny metal ring 47 is shown in the phantom and its purpose is to prevent tangling of lanyard 45 when the lid is unscrewed much like a canteen lid is fashioned. In this figure, the purge vents 124 are also shown in phantom.

I claim:

1. An air actuated diaphragm horn for assembly with a scuba diver's equipment comprising a tank of compressed air adapted to be carried on a scuba diver's back, a buoyancy pressure compensating vest to permit the scuba diver to operate in water at varying depths, connecting means between the tank of compressed air and the buoyancy pressure compensating vest, an air actuated horn having an air chamber connected to said connecting means a valve controlling said connecting means, yielding means urging the valve towards a closed position, and a manually operable push button controlling the valve.

2. The invention defined in claim 1 wherein air is released from the tank of compressed air to control the inflation of buoyancy pressure compensating vest to vary the depth in the water at which the scuba diver can operate, and manually operable means controlled by the scuba diver to control the depth in the water at which the scuba diver will operate.

3. An air actuated diaphragm horn for scuba diving comprising a resonating chamber, a plastic horn in the resonating chamber, a plurality of spaced plastic fins extending from the resonating chamber to the plastic horn a thin metal diaphragm at the apex of the plastic horn a plurality of spaced plastic fins suspending the diaphragm at the apex of the horn, a removable cover for the discharge end of the horn to provide a long range sound of as such as a mile when the cover is removed and the horn is actuated in the atmosphere and to provide a long range variational impulse of as much as a hundred yards when the cover is replaced and the horn is actuated under water.

* * * * *